US009336943B2

(12) United States Patent
Chu et al.

(10) Patent No.: US 9,336,943 B2
(45) Date of Patent: May 10, 2016

(54) TRANSFORMER

(71) Applicant: Delta Electronics (Shanghai) Co., Ltd., Shanghai (CN)

(72) Inventors: Jiang Chu, Shanghai (CN); Wei Zhang, Shanghai (CN); Zhi Huang, Shanghai (CN)

(73) Assignee: DELTA ELECTRONICS (SHANGHAI) CO., LTD., Shanghai (CN)

( * ) Notice: Subject to any disclaimer, the term of this patent is extended or adjusted under 35 U.S.C. 154(b) by 113 days.

(21) Appl. No.: 14/326,502

(22) Filed: Jul. 9, 2014

(65) Prior Publication Data

US 2015/0061807 A1 Mar. 5, 2015

(30) Foreign Application Priority Data

Sep. 4, 2013 (CN) ..... 2013 1 0398478

(51) Int. Cl.

| | |
|---|---|
| ***H01F 27/28*** | (2006.01) |
| ***H01F 27/08*** | (2006.01) |
| ***H01F 27/10*** | (2006.01) |
| ***H01F 27/02*** | (2006.01) |
| ***H01F 21/08*** | (2006.01) |
| ***H01F 30/04*** | (2006.01) |
| ***H01F 27/00*** | (2006.01) |
| ***H01F 27/34*** | (2006.01) |
| ***H01F 27/32*** | (2006.01) |

(52) U.S. Cl.

CPC ..... *H01F 30/04* (2013.01); *H01F 27/006* (2013.01); *H01F 27/08* (2013.01); *H01F 27/28* (2013.01); *H01F 27/2876* (2013.01); *H01F 27/322* (2013.01); *H01F 27/323* (2013.01); *H01F 27/34* (2013.01)

(58) Field of Classification Search

CPC ..... H01F 27/38; H01F 27/22; H01F 27/12; H01F 27/085; H01F 27/322

USPC ..... 336/55, 57, 58, 59, 60, 61, 90, 165, 336/170, 182

See application file for complete search history.

(56) References Cited

U.S. PATENT DOCUMENTS

| | | | | |
|---|---|---|---|---|
| 2,987,684 | A * | 6/1961 | Doucette, Jr. ..... | H01F 27/2823 336/12 |
| 3,710,292 | A * | 1/1973 | Van Nice ..... | H01F 27/343 336/187 |
| 4,129,938 | A * | 12/1978 | Hagenbucher ..... | H01F 41/04 156/173 |
| 4,326,181 | A * | 4/1982 | Allen ..... | H01F 27/2823 174/DIG. 25 |
| 4,663,603 | A * | 5/1987 | van Riemsdijk ..... | H01F 27/324 174/DIG. 25 |

(Continued)

*Primary Examiner* — Tsz Chan

(74) *Attorney, Agent, or Firm* — CKC & Partners Co., Ltd.

(57) ABSTRACT

A transformer includes a magnetic core, a primary winding, and a plurality of secondary windings. The magnetic core has an axial and a radial direction. The primary winding includes a plurality of winding sections and at least one connecting section. The winding sections are arranged along the axial direction. The connecting section is connected between the two adjacent winding sections. Each of the winding sections includes a plurality of primary winding layers and pull-out portions. The primary winding layers surround the magnetic core and are arranged along the radial direction. One pull-out portion connects two primary winding layers adjacent to the pull-out portion. Part of normal projections of the primary winding layers on a surface of the magnetic core are located between normal projections of the pull-out portions on the surface of the magnetic core. The secondary windings surround the primary winding.

13 Claims, 4 Drawing Sheets

(56) References Cited

U.S. PATENT DOCUMENTS 7,719,397 B2 * 5/2010 Pauley, Jr. ..... H01F 27/08
336/55

2008/0211611 A1 * 9/2008 Hanov ..... H01F 27/362
336/60

* cited by examiner

TRANSFORMER

RELATED APPLICATIONS

This application claims priority to Chinese Application Serial Number 201310398478.X, filed Sep. 4, 2013, which is herein incorporated by reference.

BACKGROUND

1. Field of Invention

The present invention relates to a magnetic device. More particularly, the present invention relates to a transformer.

2. Description of Related Art

Currently, a primary winding of a phase-shifting transformer is wound using layer winding. In layer winding, the wire is wound along the axial direction of magnetic core until the circumferential surface of the magnetic core is all wound by the wire. After that, the wire is moved outward along the radial direction and is then wound to form the next layer. Hence, the primary winding constitutes a plurality of concentric circle structures as viewed from the top. The secondary winding is mostly wound using disk winding. In disk winding, the wire is first wound around the magnetic core for one turn and is then wound outward along the radial direction. Hence, the second winding constitutes a spiral structure, such as a mosquito-repellant coil, as viewed from the top.

The uncoupled magnetic flux between the second windings and the first winding (that is the leakage flux) can generate inductive impedance that is the short-circuit impedance of the secondary windings. When a transformer is applied to a medium or high voltage inverter, a high short-circuit impedance is usually required to provide a certain amount of impedance if the medium or high voltage inverter is short-circuited. As a result, current overload problem is avoided. In view of the above, it is an issue desired to be resolved by those skilled in the art regarding how to increase the short-circuit impedance of secondary windings.

SUMMARY

One aspect of the present invention provides a transformer to increase the short-circuit impedance of the secondary windings.

The transformer includes a magnetic core, a primary winding, and a plurality of secondary windings. The magnetic core has an axial direction and a radial direction. The primary winding includes a plurality of winding sections and at least one connecting section. The plurality of winding sections are arranged along the axial direction of the magnetic core. The connecting section is connected between the two adjacent winding sections. Each of the winding sections includes a plurality of primary winding layers and a plurality of pull-out portions. The primary winding layers surround the magnetic core and are arranged along the radial direction of the magnetic core. Each of the pull-out portions connects two primary winding layers adjacent to said each of the pull-out portions. Part of normal projections of the primary winding layers on a surface of the magnetic core are located between normal projections of the pull-out portions on the surface of the magnetic core. The plurality of secondary windings surround the primary winding and are arranged along the axial direction of the magnetic core. The secondary windings are insulated from each other. Two adjacent winding sections define a first gap. Two adjacent secondary windings define a second gap. A size of the first gap or a number of the winding sections is determined based on a short-circuit impedance required by the secondary windings. A size of the second gap or a number of the secondary windings is determined based on the short-circuit impedance required by the secondary windings.

According to the above embodiments, the leakage flux space between the secondary windings and the primary winding can be increased by adjusting a gap or a number of the winding sections of the primary winding and/or a gap or a number of the secondary windings so as to increase the short-circuit impedance.

The above description is only to illustrate the problems to be resolved, technical solutions, and technical effects, etc. of the present invention. Details of the present invention will be described in the following embodiments and the accompanying drawings.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
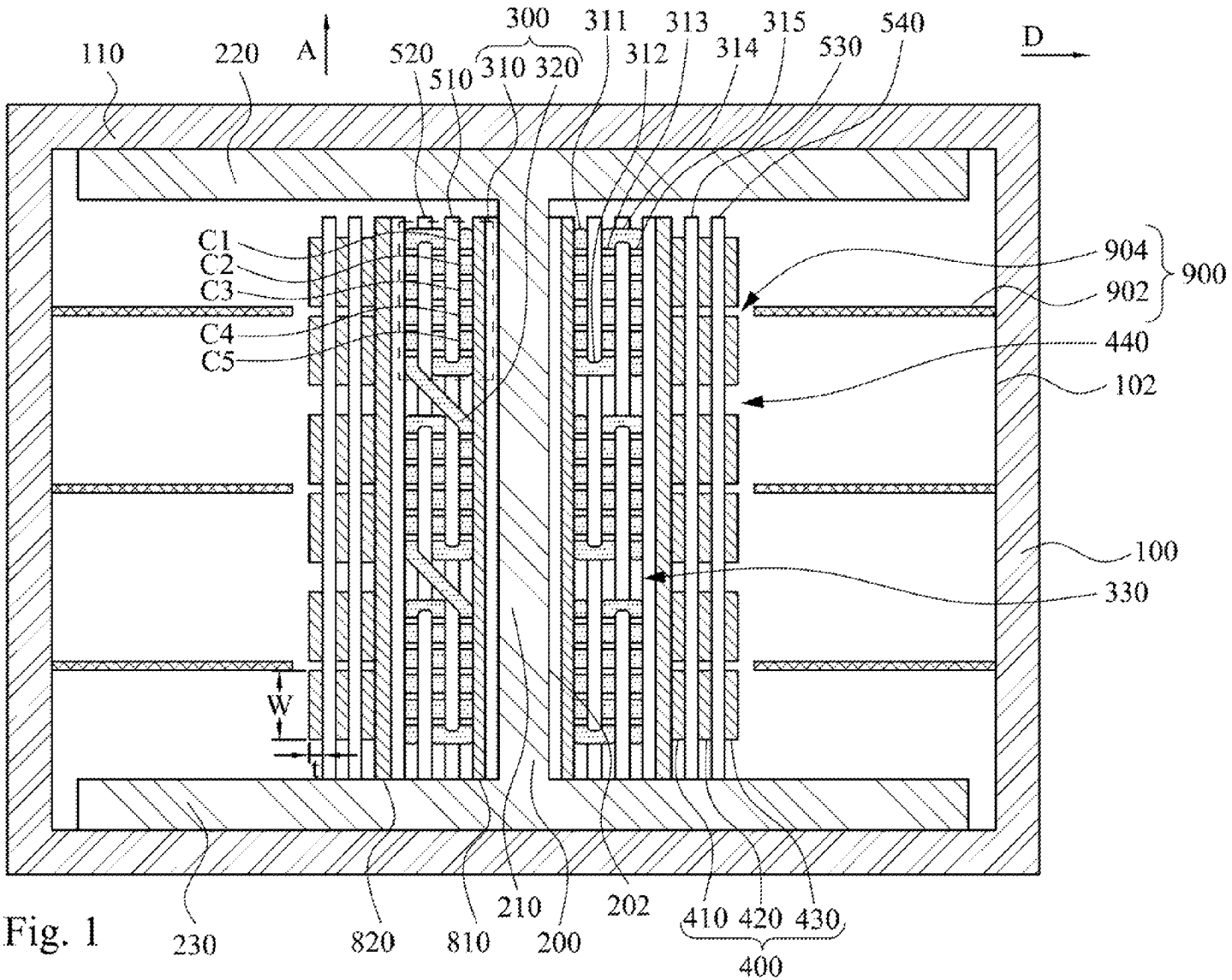
FIG. 1 depicts a cross-sectional view of a transformer according to one embodiment of this invention.

Reference will now be made in detail to the present embodiments of the invention, examples of which are illustrated in the accompanying drawings. Wherever possible, the same reference numbers are used in the drawings and the description to refer to the same or like parts.

The practical details of the invention will be described as follows, however, it should be understood that such description is only to illustrate and not to limit the scope of the invention. That is, in some embodiments of the invention, the practical details are not necessary. In addition, known structures and components are depicted schematically in the drawings.

Figure 2:
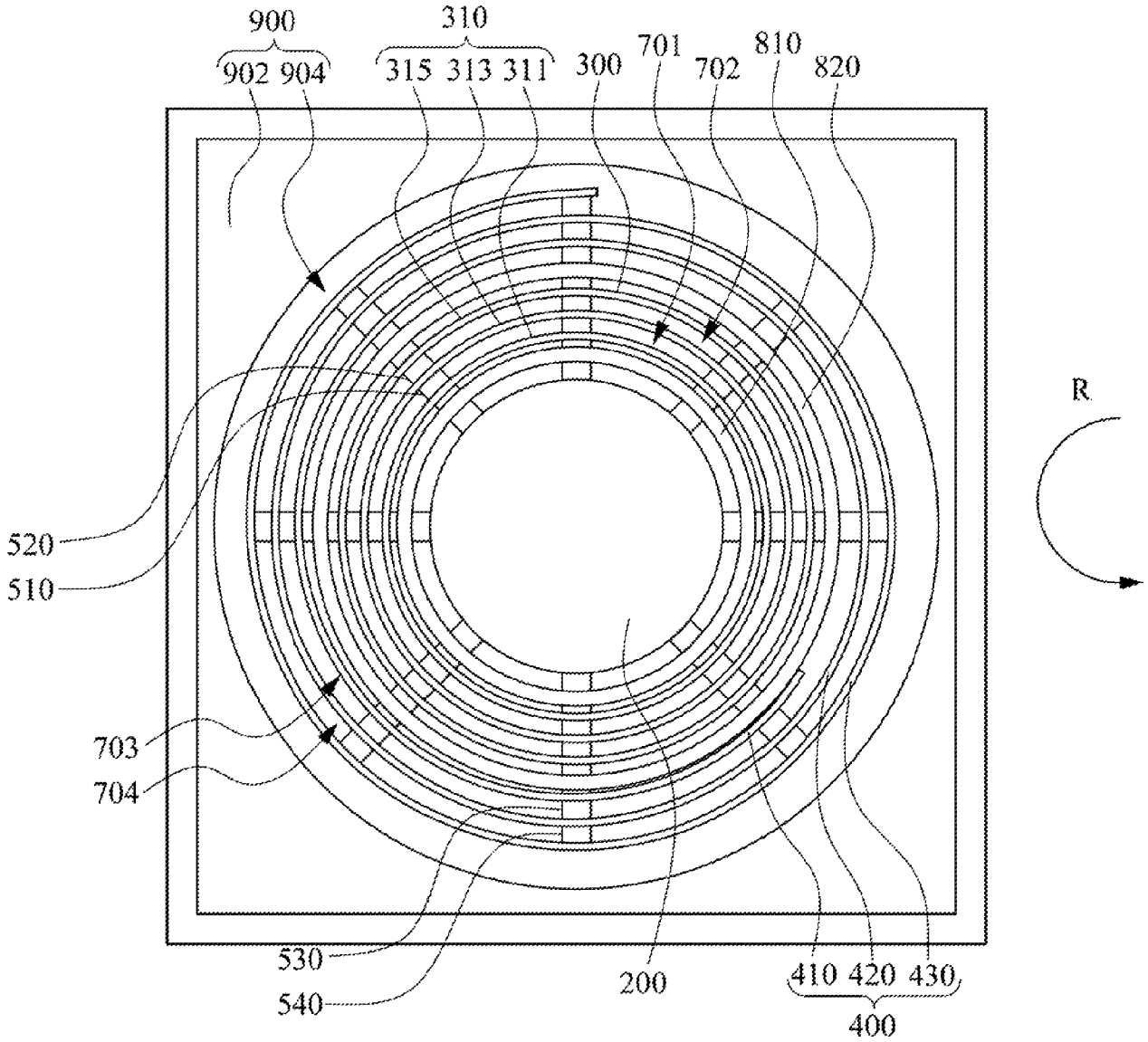
FIG. 2 depicts a top view of the transformer in FIG. 1 without a top cover of a cabinet and a core plate of a magnetic core.

FIG. 1 depicts a cross-sectional view of a transformer according to one embodiment of this invention. FIG. 2 depicts a top view of the transformer in FIG. 1 without a top cover 110 of a cabinet 100 and a core plate 220 of a magnetic core 200. As shown in FIG. 1 and FIG. 2, a transformer includes a cabinet 100, a magnetic core 200, a primary winding 300, a plurality of secondary windings 400, and two insulating cylinders 810, 820 according to the present embodiment. The cabinet 100 accommodates at least the magnetic core 200, the primary winding 300, and the secondary windings 400. The magnetic core 200 has an axial direction A and a radial direction D. The axial direction A is perpendicular to the radial direction D. The primary winding 300 is located between the insulating cylinder 810 and the insulating cylinder 820. The primary winding 300 includes a plurality of winding sections 310 and at least one connecting section 320. The plurality of winding sections 310 are arranged along the axial direction A of the magnetic core 200. The connecting section 320 is connected between two adjacent winding sections 310. Each of the winding sections 310 includes a plurality of primary winding layers 311, 313, 315 and a plurality of pull-out portions 312, 314. The primary winding layers 311, 313, 315 surround the magnetic core 200 and are arranged along the radial direction D of the magnetic core 200. The pull-out portion 312 connects the primary winding layer 311 and the primary winding layer 313. The pull-out portion 314 connects the primary winding layer 313 and the primary winding layer 315. The secondary windings 400 surround the primary winding 300 and are arranged along the axial direction A of the magnetic core 200.

The uncoupled magnetic flux between the secondary windings 400 and the primary winding 300 (that is the leakage flux) can generate inductive impedance that is the short-circuit impedance of the secondary windings 400. When a transformer is applied to a medium or high voltage inverter, a high short-circuit impedance is usually required to provide high enough impedance if the medium or high voltage inverter is short-circuited. As a result, current overload problem is avoided.

In view of the above, embodiments of the present invention provide a technical solution to increase the short-circuit impedance. In greater detail, according to one embodiment of the present invention, the leakage flux space between the secondary windings 400 and the primary winding 300 can be increased by adjusting a gap or a number of the winding sections 310 and/or a gap or a number of the secondary windings 400 so as to increase the short-circuit impedance. In more detail, a first gap 330 is defined by two adjacent winding sections 310, and a second gap 440 is defined by two adjacent secondary windings 400. A size of the first gap 330 or the number of the winding sections 310 is determined based on a short-circuit impedance required by the secondary windings 400. A size of the second gap 440 or the number of the secondary windings 400 is also determined based on the short-circuit impedance required by the secondary windings 400. In other words, an originally insufficient short-circuit impedance can be increased by adjusting the size of the first gap 330, the number of the winding sections 310, the size of the second gap 440, or the number of the secondary windings 400 so as to achieve the required short-circuit impedance.

For example, the number of the secondary windings 400 may be three to supply three-phase voltage. In order to increase the leakage flux space between the primary winding 300 and the secondary windings 400, the winding sections 310 of the primary winding 300 and the secondary windings 400 are disposed in an separated manner. In this manner, the number of the winding sections 310 may be two or four. The size of the first gap 330 is increased with a decrease in the number of the winding sections 310. Hence, the leakage flux space between the primary winding 300 and the secondary windings 400 is larger to result in a higher short-circuit impedance. It is thus understood that the number of the winding sections 310 is correlated with the size of the first gap 330, and both the number of the winding sections 310 and the size of the first gap 330 affect the short-circuit impedance. Likewise, both the number of the secondary windings 400 and the size of the second gap 440 affect the short-circuit impedance.

In the previous embodiment, the first primary winding 300 is divided into the plurality of winding sections 310 and the at least one connecting section 320. Each of the winding sections 310 and the at least one connection section 320 are formed by winding the same wire so that they constitute a series circuit. Hence, a voltage across each of the winding sections 310 is lower than a total voltage across the primary winding 300. For each of the winding sections 310, a voltage (hereinafter referred to as "inter-layer voltage") between the adjacent primary winding layers (such as between the primary winding layer 311 and the primary winding layer 313, or between the primary winding layer 313 and the primary winding layer 315) is necessarily lower than the inter-layer voltage of a traditional primary winding without being divided into sections. With such a configuration, the safety issue of partial discharge caused by high electric field strength is solved without the necessity of increasing winding radius to reduce the inter-layer voltage.

Figure 3:
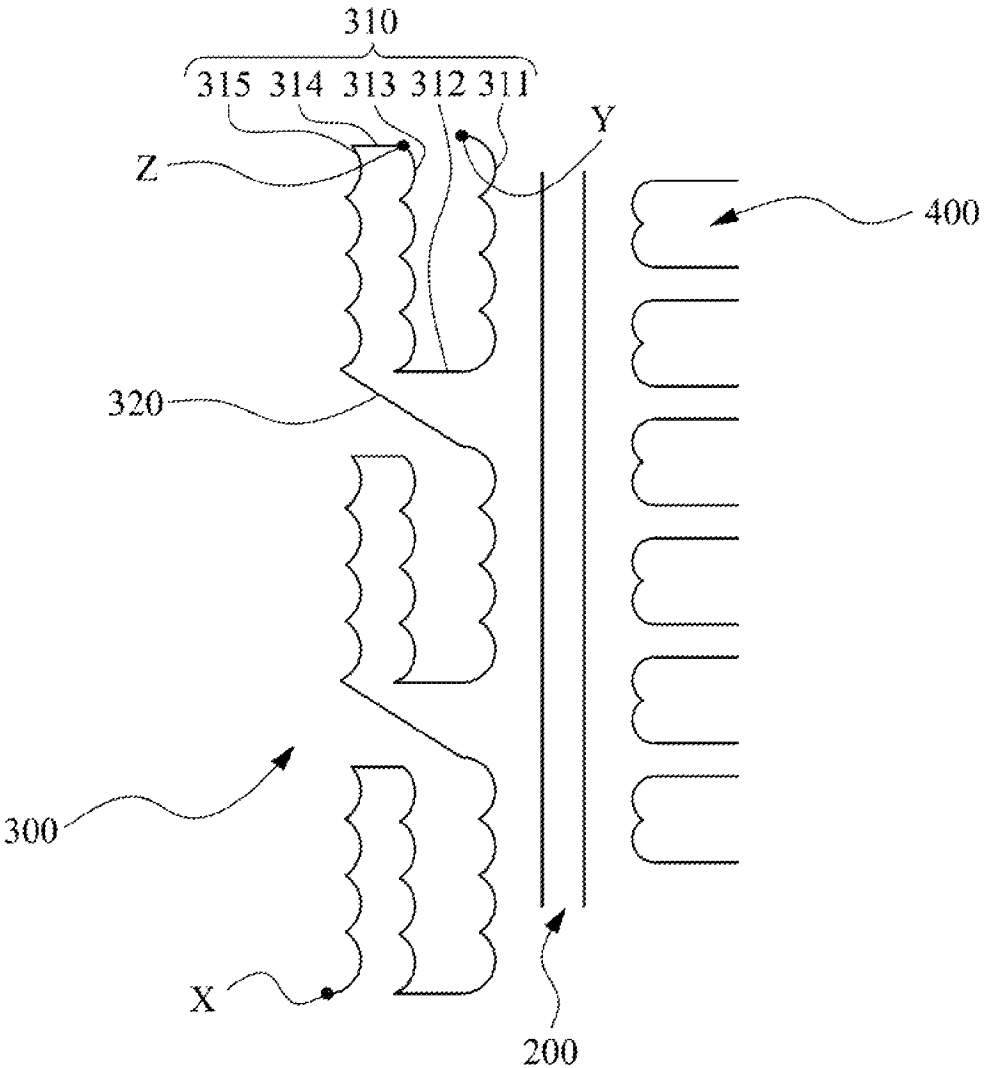
FIG. 3 depicts a circuit diagram of the transformer in FIG. 1.

FIG. 3 depicts a circuit diagram of the transformer in FIG. 1. In greater detail, as shown in FIG. 3, the three winding sections 310 and the two connecting sections 320 are connected in series to form the primary winding 300. A maximum voltage of the primary winding 300 is equal to a voltage difference between node X and node Y. That is, the maximum voltage of the primary winding 300 is $V_{xy}$. It is assumed that wire lengths in the connecting sections 320 are much less than wire lengths in the winding sections 310, voltage drops across the connecting sections 320 are thus much less than voltage drops across the winding sections 310. Hence, a maximum voltage of each of the winding sections 310 is approximately equal to $V_{xy}/3$. The maximum inter-layer voltage of each of the winding sections 310 (take the potential difference between node Y and node Z for an example) is approximately two thirds of the maximum voltage of each of the winding sections 310, that is, approximately $2V_{xy}/9$. If the primary winding 300 is not divided into sections and is also a triple-layer winding structure, the maximum inter-layer voltage would be $2V_{xy}/3$ that is approximately three times of the maximum inter-layer voltage of the primary winding 300 divided into sections. Based on the above comparison, it is easily understood that the design with the divided primary winding 300 can actually reduce the inter-layer voltage of the primary winding 300 so as to solve the safety issue of partial discharge caused by high inter-layer electric field strength.

Because the design with the divided primary winding 300 can reduce the inter-layer voltage, both gap between the primary winding layer 311 and the primary winding layer 313 and gap between the primary winding layer 313 and the primary winding layer 315 (hereinafter referred to as "inter-layer gap") may be shrunk to save space. However, when the inter-layer gap is shrunk, the leakage flux space between the secondary windings 400 and the primary winding 300 is reduced to decrease the short-circuit impedance. As mentioned previously, loss of short-circuit impedance caused by shrinkage of inter-layer gap can be compensated by adjusting the gap or the number of the winding sections 310 or the gap or the number of the secondary windings 400 even if the inter-layer gap is shrunk.

In some embodiments, as shown in FIG. 1, part of normal projections of the primary winding layers 311, 313, 315 on a surface 202 of the magnetic core 200 are located between normal projections of the pull-out portions 312, 314 on the surface 202 of the magnetic core 200. In other words, the pull-out portion 312 connects lower ends of the primary winding layers 311, 313, and the pull-out portion 314 connects upper ends of the primary winding layers 313, 315.

In some embodiments, as shown in FIG. 2, the primary winding layers 311, 313, 315 are arranged in concentric rings as viewed from the top. The primary winding layer 311 surrounds the magnetic core 200, the primary winding layer 313 surrounds the primary winding layer 311, and the primary winding layer 315 surrounds the primary winding layer 313. In some embodiments, the transformer further includes a plurality of primary stays 510 and a plurality of primary stays 520 to separate the primary winding layers 311, 313, 315 so as to facilitate heat dissipation.

In greater detail, as shown in FIG. 2, the plurality of primary stays 510 are disposed between the primary winding layer 311 and the primary winding layer 313 so as to separate the primary winding layer 311 and the primary winding layer 313. Furthermore, the magnetic core 200 has a circumference direction R. The circumference direction R is parallel with circumferences formed by winding around the axial direction A (see FIG. 1) of the magnetic core 200. The plurality of primary stays 510 are disposed between the primary winding layer 311 and the primary winding layer 313 and arranged along the circumference direction R of the magnetic core 200. Each of the primary stays 510 is separate from the other primary stays 510. A primary air duct 701 is defined within the two adjacent primary stays 510, the primary winding layer 311, and the primary winding layer 313. Since the primary winding layer 311 and the primary winding layer 313 are arranged along the radial direction D (see FIG. 1) of the magnetic core 200, a lengthwise direction of the primary air duct 701 between the primary winding layer 311 and the primary winding layer 313 can be parallel with the axial direction A (see FIG. 1) of the magnetic core 200.

Similarly, the primary stays 520 are disposed between the primary winding layer 313 and the primary winding layer 315 so as to separate the primary winding layer 313 and the primary winding layer 315. Furthermore, the primary stays 520 are disposed between the primary winding layer 313 and the primary winding layer 315 and arranged along the circumference direction R of the magnetic core 200. Each of the primary stays 520 is separate from the other primary stays 520. A primary air duct 702 is defined within the two adjacent primary stays 520, the primary winding layer 313, and the primary winding layer 315. Since the primary winding layer 313 and the primary winding layer 315 are arranged along the radial direction D (see FIG. 1) of the magnetic core 200, a lengthwise direction of the primary air duct 702 between the primary winding layer 313 and the primary winding layer 315 can be parallel with the axial direction A (see FIG. 1) of the magnetic core 200.

Since airflow generated by a cooling fan (not shown in the figure) of the transformer generally flows along the axial direction A of the magnetic core 200, the fact that the lengthwise directions of the primary air duct 701 and the primary air conduct 702 are both parallel with the axial direction A (see FIG. 1) of the magnetic core 200 would facilitate the passing through of airflow to help heat dissipation. It should be understood that, as used herein, the term "lengthwise direction" of one component refers to the direction parallel with the longest side of the component.

In some embodiments, the leakage flux space may be changed by modifying the primary air duct 701 and the primary air conduct 702 so as to adjust the short-circuit impedance. In greater detail, as shown in FIG. 2, both the primary air duct 701 and the primary air conduct 702 have a radial dimension along the radial direction D (see FIG. 1) of the magnetic core 200. The radial dimensions of the primary air duct 701 and the primary air conduct 702 are determined based on the short-circuit impedance required by the secondary windings 400. In other words, when the short-circuit impedance is not sufficient, the leakage flux space can be increased through increasing the radial dimensions of the primary air duct 701 and the primary air conduct 702 so as to increase the short-circuit impedance.

In some embodiments, as shown in FIG. 1, each of the secondary windings 400 includes a plurality of secondary winding layers 410, 420, 430. The plurality of secondary winding layers 410, 420, 430 are arranged along the radial direction D of the magnetic core 200. As shown in FIG. 2, the secondary winding layers 410, 420, 430 are spirally wound from inside to outside (or vice versa from outside to inside) as viewed from the top. In greater detail, the secondary winding 400 may be made up of a single wire. The wire is first wound for one turn to form the secondary winding layer 410, and is then wound along the radial direction D to the outside of the secondary winding layer 410 to form the secondary winding layer 420. After the wire is wound for another turn, it is wound along the radial direction D to the outside of the secondary winding layer 420 to form the secondary winding layer 430. In some embodiments, the innermost secondary winding layer 410 surrounds the primary winding layer 315 with the insulating cylinder 820 therebetween to avoid the electrical effects on each other.

Since the secondary winding of the traditional transformer is a structure in a form of directly superimposed layers, there is no axial air duct between layers, which is disadvantageous for heat dissipation. In another embodiment of the present invention, a technical solution to facilitate heat dissipation of the secondary windings 400 is thus provided. According to the embodiment, as shown in FIG. 1, the transformer further includes a plurality of secondary stays 530 and a plurality of secondary stays 540 to separate the secondary winding layers 410, 420, 430 so as to facilitate heat dissipation.

In greater detail, as shown in FIG. 2, the secondary stays 530 are disposed between the secondary winding layer 410 and the secondary winding layer 420 so as to separate the secondary winding layer 410 and the secondary winding layer 420. Furthermore, the secondary stays 530 are disposed between the secondary winding layer 410 and the secondary winding layer 420 and arranged along the circumference direction R of the magnetic core 200. The secondary stays 530 are separate from each other. A secondary air duct 703 is defined within two adjacent secondary stays 530, the secondary winding layer 410, and the secondary winding layer 420. Since the secondary winding layer 410 and the secondary winding layer 420 are arranged along the radial direction D (see FIG. 1) of the magnetic core 200, a lengthwise direction of the secondary air duct 703 between the secondary winding layer 410 and the secondary winding layer 420 can be parallel with the axial direction A (see FIG. 1) of the magnetic core 200.

Similarly, as shown in FIG. 2, the plurality of secondary stays 540 are disposed between the secondary winding layer 420 and the secondary winding layer 430 so as to separate the secondary winding layer 420 and the secondary winding layer 430. Furthermore, the secondary stays 540 are disposed between the secondary winding layer 420 and the secondary winding layer 430 and arranged along the circumference direction R of the magnetic core 200. Each of the secondary stays 540 is separate from the other secondary stays 540. A secondary air duct 704 is defined within the two adjacent secondary stays 540, the secondary winding layer 420, and the secondary winding layer 430. Since the secondary winding layer 420 and the secondary winding layer 430 are arranged along the radial direction D (see FIG. 1) of the magnetic core 200, a lengthwise direction of the secondary air duct 704 between the secondary winding layer 420 and the secondary winding layer 430 can be parallel with the axial direction A (see FIG. 1) of the magnetic core 200.

Because airflow generated by the cooling fan (not shown in the figure) of the transformer generally flows along the axial direction A of the magnetic core 200, the fact that the lengthwise directions of the secondary air duct 703 and the secondary air conduct 704 are both parallel with the axial direction A (see FIG. 1) of the magnetic core 200 would facilitate the passing through of airflow to help heat dissipation. In some embodiments, the lengthwise directions of the primary air ducts 701, 702 and the secondary air ducts 703, 704 are all parallel with the axial direction A of the magnetic core 200 to greatly improve overall heat dissipation performance of the transformer.

In some embodiments, the leakage flux space may be changed by altering the secondary air duct 703 and the secondary air conduct 704 so as to adjust the short-circuit impedance. In greater detail, as shown in FIG. 2, both the secondary air duct 703 and the secondary air conduct 704 have a radial dimension along the radial direction D (see FIG. 1) of the magnetic core 200. The radial dimensions of the secondary air duct 703 and the secondary air conduct 704 are determined based on the short-circuit impedance required by the secondary windings 400. In other words, when the short-circuit impedance is not sufficient, the leakage flux space can be increased through increasing the radial dimensions of the secondary air duct 703 and the secondary air duct 704 so as to increase the short-circuit impedance.

In some embodiments, as shown in FIG. 1, each of the secondary windings 400 is formed by winding a strip conductor. The strip conductor has a width w along the axial direction A of the magnetic core 200, and a thickness t along the radial direction D of the magnetic core 200. A ratio of the width w to the thickness t satisfies: $10 \leq w/t$. Because the width w of the strip conductor is large, such a big dimension along the axial direction A allows the formation of the secondary air ducts 703 and the secondary air ducts 704 (see FIG. 2) having the lengthwise directions parallel with the axial direction A within the secondary winding 400.

In some embodiments, as shown in FIG. 1, the transformer further includes at least one windshield panel 900. The windshield panel 900 has at least one main surface 902. The cabinet 100 has at least one inner surface 102. The main surface 902 of the windshield panel 900 is located between the inner surface 102 of the cabinet 100 and the secondary winding 400, and the main surface 902 of the windshield panel 900 is parallel with the radial direction D of the magnetic core 200. With such a configuration, the windshield panel 900 can prevent airflow generated by the cooling fan (not shown in the figure) from flowing along the axial direction A outside the secondary windings 400 so as to force most airflow flowing toward the primary air ducts 701, 702 and the secondary air ducts 703, 704 (see FIG. 2).

In greater detail, as shown in FIG. 2, the windshield panel 900 has an opening 904. The opening 904 is formed on the main surface 902 to expose the magnetic core 200, the primary winding 300, and the secondary windings 400. Hence, most airflow generated by the cooling fan (not shown in the figure) is forced to flow toward the opening 904 of the main surface 902 to improve heat dissipation performances of the magnetic core 200, the primary winding 300, and the secondary windings 400.

In some embodiments, as shown in FIG. 1, a number of the at least one windshield panel 900 is plural. The windshield panels 900 are arranged along the axial direction A of the magnetic core 200. In other words, the windshield panels 900 are arranged on the inner surface 102 of the cabinet 100 along the axial direction A. With such a configuration, airflow generated by the cooling fan (not shown in the figure) is further prevented from flowing outside the secondary windings 400. In some embodiments, the openings 904 of the windshield panels 900 are aligned to facilitate the passing through of airflow.

In some embodiments, as shown in FIG. 1, the windshield panels 900 and the secondary windings 400 are disposed in an alternating manner to prevent part of the airflow from flowing outward from the second gap 440 between the two adjacent secondary windings 400 along the radial direction D. In greater detail, at least part of a normal projection of each of the windshield panels 900 on the surface 202 of the magnetic core 200 is located between normal projections of the two secondary windings 400 adjacent to the each of the windshield panels 900 on the surface 202 of the magnetic core 200.

In some embodiments, the larger the size of the second gaps 440, the more airflow flows outward through the second gaps 440 along the radial direction. Hence, in some embodiments, when one of the second gaps 440 has a larger size than the size of the at least one second gap 440 other than the one of the second gaps 440, the windshield panel 900 can be aligned with the one of the second gaps 440. In other words, the windshield panel 900 is disposed in such a manner that it corresponds to the second gap 440 having the larger size so as to block lateral airflow.

In some embodiments, as shown in FIG. 1, the secondary windings 400 arranged along the axial direction A are insulated from each other. That is, each of the secondary windings 400 is not electrically conducted to the at least one secondary winding 400 other than the each of the secondary windings 400. Each of the secondary windings 400 is configured for outputting a voltage having a phase angle different from the other secondary windings 400 so as to realize a shift transformer.

In some embodiments, as shown in FIG. 1, the first winding 300 is made up of a single wire. Each of the winding sections 310 is wound using layer winding. That is, each of the primary winding layers (including 311, 313, and 315) includes a plurality of coils arranged along the axial direction A. For example, when winding, the wire is first wound around the magnetic core 200 for one turn to form coil C1 and then moved downward along the axial direction A of the magnetic core 200. After that, the wire is wound around the magnetic core 200 to form coil C2. Coils C3, C4, and C5 are formed in the same manner. The coils C1, C2, C3, C4, and C5 constitute the primary winding layer 311. After the coil C5 is formed, the wire is wound along the radial direction D until reaching the outside of the primary stay 510 to form the pull-out portion 312 across the primary stay 510. Then, the wire is wound upward to form the primary winding layer 313 having a plurality of coils. When reaching a specific horizontal position, the wire is wound outward until reaching the outside of the primary stay 520 to form the pull-out portion 314 across the primary stay 520. After that, the wire is wound downward to form the primary winding layer 315 having a plurality of coils. When reaching another specific horizontal position, the wire is pulled downward to the inside of the primary stay 510, and the portion being pulled from the outside of the primary stay 520 to the inside of the primary stay 510 is the connecting section 320. The wire being pulled to the inside of the primary stay 510 then continues to be wound by repeating the above winding method for forming the winding section 310 so as to form another one of the winding sections 310. In other words, the connecting section 320 of the primary winding 300 connects the primary winding layer 315 farthest from the magnetic core 200 of one of the winding sections 310 and the primary winding layer 311 nearest to the magnetic core 200 of another one of the winding sections 310.

In some embodiments, as shown in FIG. 1, the magnetic core 200 includes a center column 210, the core plate 220, and a core plate 230. The core plate 220 and the core plate 230 are respectively connected to two opposite ends of the center column 210. Both the primary winding 300 and the secondary windings 400 surround the center column 210 and are located between the core plate 220 and the core plate 230. The center column 210, the core plate 220, and the core plate 230 are all made of a magnetic material, such as iron, but the present invention is not limited in this regard.

Figure 4:
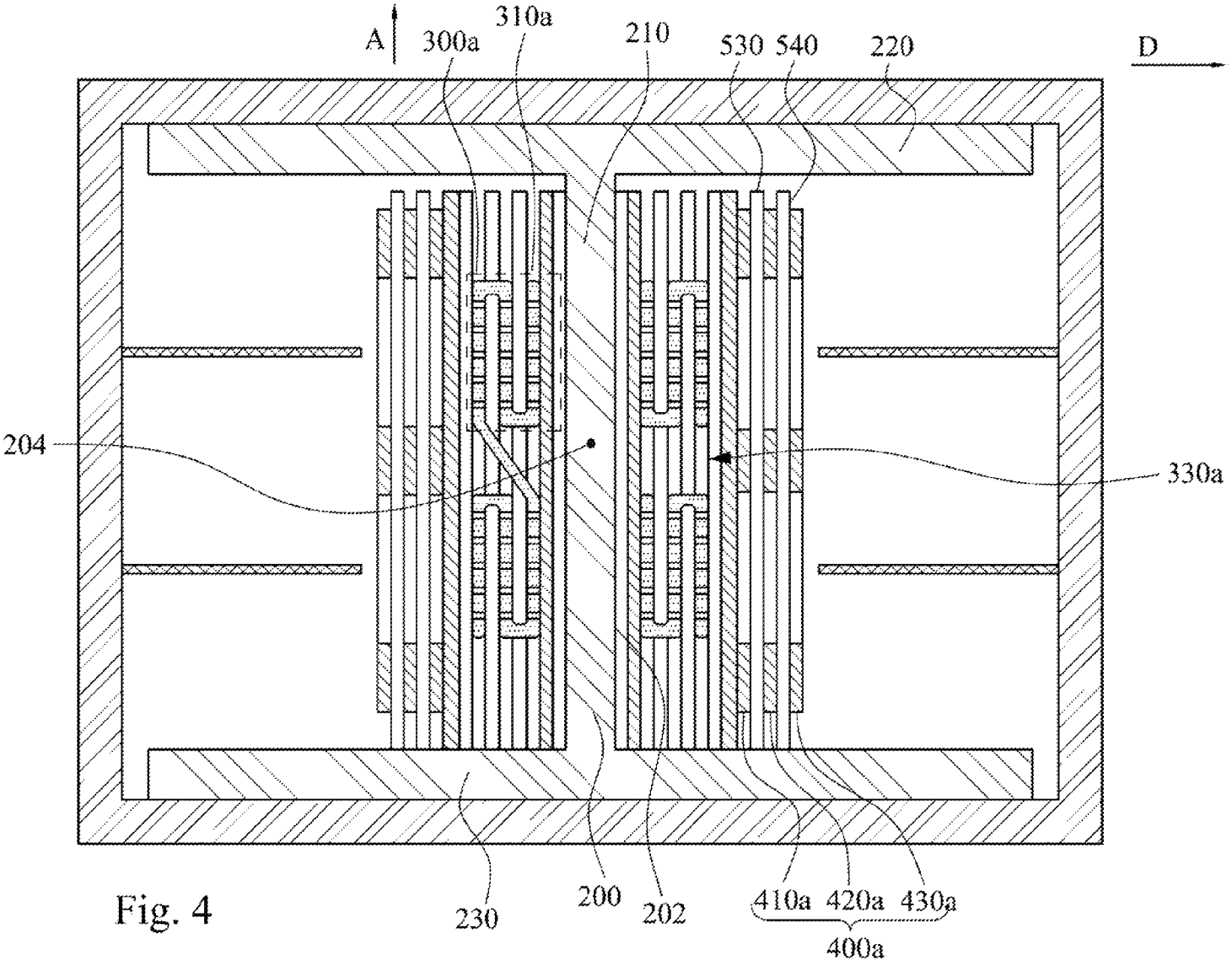
FIG. 4 depicts a cross-sectional view of a transformer according to another embodiment of this invention.

According to another embodiment of the present invention, a technical solution to further increase short-circuit impedance is provided. FIG. 4 depicts a cross-sectional view of a transformer according to another embodiment of this invention. As shown in FIG. 4, the present embodiment at least differs from the above-mentioned embodiment shown in FIG. 1 in that the secondary windings 400*a* and the winding sections 310*a* of the primary winding 310 are disposed in an alternating manner. In greater detail, at least part of a normal projection of one of the secondary windings 400*a* on the surface 202 of the magnetic core 200 is located between normal projections of two adjacent winding sections 310*a* on the surface 202 of the magnetic core 200. With such a configuration, the leakage flux between the secondary windings 400*a* and the primary winding 300*a* can be increased to increase the short-circuit impedance. It should be understood that the secondary winding 400*a* and the winding sections 310*a* of the primary winding 300*a* are completely staggered according to the present embodiment. That is, the normal projections of the secondary winding 400*a* and the winding sections 310*a* of the primary winding 300*a* on the surface 202 of the magnetic core 200 are completely separated. However, in other embodiments, the secondary winding 400*a* and the winding sections 310*a* of the primary winding 300*a* may be partially staggered. That is, the normal projections of the secondary winding 400*a* and the winding sections 310*a* of the primary winding 300*a* on the surface 202 of the magnetic core 200 may partially overlap.

In some embodiments, as shown in FIG. 4, the magnetic core 200 has a core center 204 within the center column 210. The core center 204 has a same distance from the core plate 220 and the core plate 230. The axial direction A of the magnetic core 200 is across the core plate 220 and the core plate 230. The secondary windings 400*a* close to the core plate 220 and the core plate 230 tend to generate more leakage flux because the leakage flux paths for the secondary windings 400*a* close to the core plate 220 and the core plate 230 pass through the magnetic conductive core plate 220 and core plate 230, respectively. The secondary winding 400*a* close to the core center 204 tends to generate less leakage flux because the leakage flux path for the secondary winding 400*a* close to the core center 204 does not pass through any portion of the magnetic core 200. Hence, the leakage flux of the secondary windings 400*a* close to the core plate 220 and the core plate 230 is higher than the leakage flux of the secondary winding 400*a* that close to the core center 204. As a result, the secondary winding 400*a* close to the core center 204 has a lower short-circuit impedance so that the short-circuit impedances among the secondary windings 400*a* are not uniform.

Hence, according to some embodiments of the present invention, the short-circuit impedances of the different secondary windings 400*a* can be uniformed by differentiating the size of the first gaps 330. In greater detail, as shown in FIG. 4, the size of the first gaps 330 closest to the core plate 220 and the core plate 230 is smaller than the size of the at least one first gap 330 other than the first gaps 330 closest to the core plate 220 and the core plate 230. With such a configuration, the short-circuit impedances of the secondary windings 400*a* close to the core plate 220 and the core plate 230 are decreased and the short-circuit impedance of the secondary winding 400*a* close to the core center 204 is increased so that the short-circuit impedances at different locations in the transformer are more uniform.

In some embodiments, the secondary windings 400*a* closer to the core plate 220 and the core plate 230 may be moved toward the core center 204 of the magnetic core 200 so as to reduce the leakage flux of the of the secondary windings 400*a* passing through the core plate 220 and the core plate 230. With such a configuration, the short-circuit impedance values of the secondary windings 400*a* closer to the core plate 220 and the core plate 230 are closer to the short-circuit impedance value of the secondary winding 400*a* closer to the core center 204. As a result, the short-circuit impedances at different locations in the transformer are more uniform.

According to some embodiments, the number of the secondary windings 400*a* is an odd number. In greater detail, the number of the secondary windings 400*a* may be three so as to supply voltages having three different phases as required by the three-phase voltage. In some embodiments, the number of the winding sections 310*a* is an even number (such as two or four), and a number of the at least one first gap 330 may be an odd number so that the at least one first gap 330 can be disposed corresponding to the odd-numbered secondary windings 400*a*.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A transformer, comprising:

a magnetic core having an axial direction and a radial direction;

a primary winding comprising a plurality of winding sections and at least one connecting section, the plurality of winding sections being arranged along the axial direction of the magnetic core, the connecting section being connected between the two adjacent winding sections, each of the winding sections comprising a plurality of primary winding layers and a plurality of pull-out portions, the primary winding layers surrounding the magnetic core and arranged along the radial direction of the magnetic core, each of the pull-out portions connecting two of the primary winding layers adjacent to said each of the pull-out portions, part of normal projections of the primary winding layers on a surface of the magnetic core being located between normal projections of the pull-out portions on the surface of the magnetic core; and a plurality of secondary windings surrounding the primary winding and arranged along the axial direction of the magnetic core, the secondary windings being insulated from each other;

wherein adjacent two of the winding sections define a first gap, adjacent two of the secondary windings define a second gap, a size of the first gap or a number of the winding sections is determined based on a short-circuit impedance required by the secondary windings, and a size of the second gap or a number of the secondary windings is determined based on the short-circuit impedance required by the secondary windings.

2. The transformer of claim 1, further comprising:

a plurality of primary stays, each of the primary stays disposed between adjacent two of the primary winding layers, a primary air duct being defined within said each of the primary stays, the primary stay adjacent to said each of the primary stays, and adjacent two of the primary winding layers, the primary air duct having a lengthwise direction parallel with the axial direction of the magnetic core.

3. The transformer of claim 2, wherein the primary air duct has a radial dimension along the radial direction of the magnetic core, the radial dimension of the primary air duct is determined based on the short-circuit impedance required by the secondary windings.

4. The transformer of claim 1, further comprising:

a plurality of secondary stays, each of the secondary windings comprising a plurality of secondary winding layers arranged along the radial direction of the magnetic core, each of the secondary stays disposed between adjacent two of the secondary winding layers, a secondary air duct being defined within said each of the secondary stays, the secondary stay adjacent to said each of the secondary stays, and adjacent two of the secondary winding layers, the secondary air duct having a lengthwise direction parallel with the axial direction of the magnetic core.

5. The transformer of claim 4, wherein the secondary air duct has a radial dimension along the radial direction of the magnetic core, the radial dimension of the secondary air duct is determined based on the short-circuit impedance required by the secondary windings.

6. The transformer of claim 1, wherein at least part of a normal projection of one of the secondary windings on the surface of the magnetic core is located between normal projections of adjacent two of the winding sections on the surface of the magnetic core.

7. The transformer of claim 1, wherein the magnetic core has two core plates opposite to each other, the axial direction of the magnetic core being across the core plates, the size of the first gaps closest to the core plates is smaller than the size of the at least one first gap other than the first gaps closest to the core plates.

8. The transformer of claim 1, further comprising:

a cabinet accommodating the magnetic core, the primary winding, and the secondary windings, the cabinet having at least one inner surface; and at least one windshield panel, the windshield panel having at least one main surface, the main surface being located between the inner surface of the cabinet and one of the secondary windings, and the main surface being parallel with the radial direction of the magnetic core.

9. The transformer of claim 8, wherein a number of said at least one windshield panel is plural, the windshield panels are arranged along the axial direction of the magnetic core.

10. The transformer of claim 8, wherein at least part of a normal projection of each of the windshield panels on the surface of the magnetic core is located between normal projections of adjacent two of the two secondary windings on the surface of the magnetic core.

11. The transformer of claim 8, wherein at least one of the second gaps is aligned with the windshield panel, the size of said at least one of the second gaps is larger than the size of the at least one second gap other than said at least one of the second gaps.

12. The transformer of claim 1, wherein at least one of the secondary windings is formed by winding a strip conductor, the strip conductor has a width w along the axial direction of the magnetic core and a thickness t along the radial direction of the magnetic core, a ratio of the width w to the thickness t satisfies: $10 \leq w/t$.

13. The transformer of claim 1, wherein the number of the winding sections is an even number, and a number of the at least one first gap is an odd number.

* * * * *